US011183323B2

(12) United States Patent
Xu et al.

(10) Patent No.: US 11,183,323 B2
(45) Date of Patent: Nov. 23, 2021

(54) MAGNETIC CORE COMPONENT AND GAP CONTROL METHOD THEREOF

(71) Applicant: Delta Electronics,Inc., Taoyuan (CN)

(72) Inventors: Haibin Xu, Taoyuan (CN); Tao Wang, Taoyuan (CN); Shouyu Hong, Taoyuan (CN); Zhenqing Zhao, Taoyuan (CN); Yicong Xie, Taoyuan (CN); Zengsheng Wang, Taoyuan (CN)

(73) Assignee: DELTA ELECTRONICS, INC., Taoyuan (CN)

( * ) Notice: Subject to any disclaimer, the term of this patent is extended or adjusted under 35 U.S.C. 154(b) by 208 days.

(21) Appl. No.: 16/104,961

(22) Filed: Aug. 20, 2018

(65) Prior Publication Data

US 2018/0358157 A1 Dec. 13, 2018

Related U.S. Application Data

(62) Division of application No. 14/879,263, filed on Oct. 9, 2015, now abandoned.

(30) Foreign Application Priority Data

Oct. 15, 2014 (CN) ..... 201410545191.X

(51) Int. Cl.

| | |
|---|---|
| ***H01F 3/14*** | (2006.01) |
| ***H01F 3/10*** | (2006.01) |
| ***H01F 3/12*** | (2006.01) |
| *H01F 27/28* | (2006.01) |

(52) U.S. Cl.
CPC ..... *H01F 3/14* (2013.01); *H01F 3/10* (2013.01); *H01F 3/12* (2013.01); *H01F 27/2804* (2013.01)

(58) Field of Classification Search
CPC ... H01F 27/00–40; H01F 3/14; H01F 27/2804
See application file for complete search history.

(56) References Cited

U.S. PATENT DOCUMENTS

| | | | | |
|---|---|---|---|---|
| 1,748,993 A * | 3/1930 | Purdy | ..... | H01F 41/04 336/178 |
| 4,095,206 A * | 6/1978 | Hishiki | ..... | H01F 27/022 336/178 |
| 5,204,653 A * | 4/1993 | Saitoh | ..... | H01F 27/263 336/178 |
| 2014/0085030 A1* | 3/2014 | Lin | ..... | H01F 27/306 336/175 |

* cited by examiner

*Primary Examiner* — Tuyen T Nguyen
(74) *Attorney, Agent, or Firm* — Qinghong Xu

(57) ABSTRACT

There is provided a magnetic core component and the gap control method thereof. The magnetic core component includes a first magnetic component, a second magnetic component and a first gap control structure disposed therebetween. The first gap control structure includes thixotropic material and is applied on the first magnetic component and is cured, the second magnetic component is disposed on the cured first gap control structure, and a gap between the first magnetic component and the second magnetic component is controlled by an effective height of the first gap control structure. The gap control structure has minimum variability after it is cured, and its effective height can be always kept at a required gap height.

13 Claims, 26 Drawing Sheets

MAGNETIC CORE COMPONENT AND GAP CONTROL METHOD THEREOF

RELATED APPLICATIONS

This application is a divisional application of U.S. application Ser. No. 14/879,263, entitled "Magnetic Core Component and Gap Control Method Thereof" filed on Oct. 9, 2015, which claims priority to China Application Serial Number 201410545191.X, filed Oct. 15, 2014. The contents of these applications are hereby incorporated by reference.

TECHNICAL FIELD

The present disclosure generally relates to a magnetic core component, and more particularly, to control of the gap thereof.

BACKGROUND

For a magnetic core component, the gap among its magnetic cores or between its magnetic cores and coils may directly affect its inductance value, winding loss and the like. However, the gap among magnetic cores need be precisely controlled so that the gap among magnetic cores and between magnetic cores and coils keep consistent, making the inductance value not deviate from an optimal design point of a circuit, reducing efficiency loss of the circuit and guaranteeing the dynamic adjustment range of the circuit being the original one. Meanwhile, the gap may also affect winding loss of a magnetic core component, so an accurate gap design may facilitate a loss control of the magnetic core component. Therefore an accurate gap control is of vital importance.

SUMMARY

According to one aspect of the present disclosure, there is provided a magnetic core component, which includes a first magnetic component, a second magnetic component and a first gap control structure disposed between the first magnetic component and the second magnetic component, wherein the first gap control structure includes thixotropic material, is applied on the first magnetic component, the second magnetic component is disposed on the first gap control structure cured, and the gap between the first magnetic component and the second magnetic component is controlled by the effective height of the first gap control structure.

According to another aspect of the present disclosure, there is provided a method for controlling a gap of the magnetic core component, which includes a first magnetic component and a second magnetic component arranged oppositely, a gap is provided between the first magnetic component and the second magnetic component, and the gap control method includes following steps: applying a first gap control structure on the first magnetic component, wherein the first gap control structure including thixotropic material; curing the first gap control structure; detecting the effective height of the first gap control structure and adjusting adhesive dispensing and applying parameters so that the effective height of the first gap control structure is equal to an expected value of the gap; and assembling the second magnetic component and the first magnetic component to form the magnetic core component.

According to another aspect of the present disclosure, there is provided a magnetic core component, which include: a first magnetic component including two projections and a holding space disposed between both the projections: a second magnetic component arranged oppositely to the first magnetic component; a first gap control structure disposed between the projections of the first magnetic component and the second magnetic component; a coil disposed in the holding space of the first magnetic component; and a second gap control structure disposed between the first magnetic component and the coil. Wherein, both the first gap control structure and the second gap control structure include thixotropic material, a first gap is provided between the first magnetic component and the second magnetic component, a second gap is provided between a lower surface of the coil and the first magnetic component, a third gap is provided between an upper surface of the coil and the second magnetic component, and the first gap, the second gap and the third gap are controlled by effective heights of the first gap control structure and the second gap control structure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DESCRIPTION OF THE EMBODIMENTS

Figure 1:
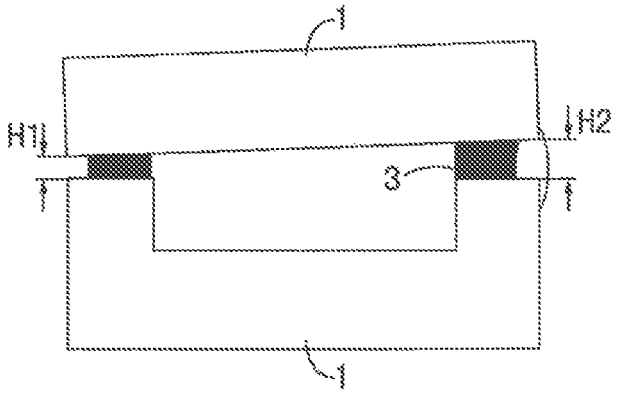
Fig. 1 (Prior Art)
FIG. 1 shows a schematic diagram of a conventional magnetic core structure.

In one conventional magnetic core structure as shown in FIG. 1, a Mylar (a polyester film) 3 having a fixed thickness is provided between two upper and lower magnetic cores 1. Because the Mylar itself has a thickness tolerance, generally a magnetic core component assembled using the Mylar has a gap height tolerance of about ±15%. As shown in FIG. 1, the magnetic core component assembled using the Mylar has a left gap H1 and a right gap H2, and a deviation of ±15% exists between the (H1+H2)/2 and a designed gap height, thereby having a negative effect on winding loss between magnetic cores. Generally the Mylar may have several fixed thicknesses according to corresponding specifications, for example, 50 um, 70 um, 100 um and so on, but due to non-uniform thickness, corresponding gap height control precision is low, leading to failure of meeting high precision requirements and achieving a circuit optimal design with high efficiency.

Figure 2:
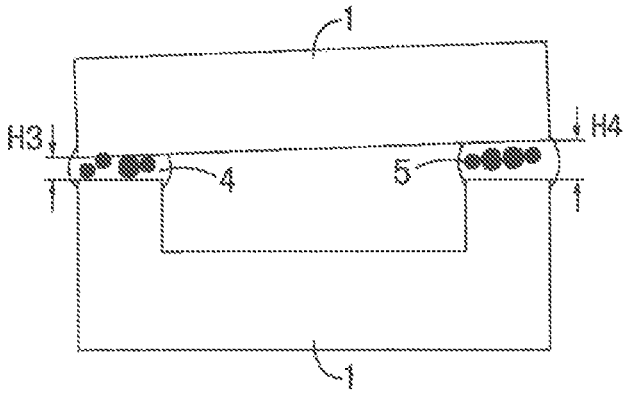
Fig.2 (Prior Art)
FIG. 2 shows a schematic diagram of another conventional magnetic core structure.

In one conventional magnetic core structure as shown in FIG. 2, fixing glue 4 is adhered between the upper and lower magnetic cores 1, and a filler 5 fitting in with the required gap size, which may be a glass bead or a ceramic bead, is added into the fixing glue 4. The filler 5 has a customizable diameter, thus it may meet a gap of any size. However, the fixing glue mixed with the filler 5 has higher viscosity (or thickness) and tends to layering, making it difficult to control in an actual process. The left and right gaps of the magnetic cores assembled are respectively are defined as H3 and H4 and (H3+H4)/2 is defined as a gap height reached using the fixing glue 4, which has a deviation of ±8% from a designed gap height in general, thereby having a negative effect on winding loss between the magnetic cores. Therefore, it is not easy to make an accurate size control and achieve a required gap using this method.

These is provided a magnetic core component and a gap control method for the magnetic core component so as to meet a precise control of a magnetic core gap of any height within 50~2000 um and to reduce error in size of the gap substantially.

Now, exemplary embodiments will be described more comprehensively with reference to the drawings. However, the exemplary embodiments may be earned out in various manners, and shall not be interpreted as being limited to the embodiments set forth herein; instead, providing these embodiments will make the present disclosure more comprehensive and complete, and will fully convey the conception of the exemplary embodiments to those skilled in the art. In drawings, thickness of areas and layers is exaggerated for distinctness. The same numbers in drawings represent the same or similar structures, and thus detailed description thereof is omitted.

Characteristics, structures or features as described may be incorporated into one or more embodiments in any right way. In the following description, many specific details are provided to facilitate sufficient understanding of the embodiments of the present disclosure. However, those skilled in the art will appreciate that the technical solutions in the present disclosure may be practiced without one or more of the specific details, or other methods, elements, materials and so on may be employed. In other circumstances, well-known structures, materials or operations are not shown or described in detail to avoid confusion of aspects of the present disclosure.

Figure 3:
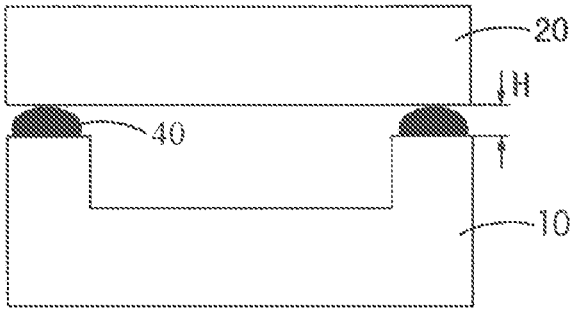
FIG. 3 is a schematic diagram of a magnetic core component according to one embodiment.

Referring to FIG. 3, an embodiment of the present disclosure provides a magnetic core component, which includes a first magnetic component 10, a second magnetic component 20 and a first gap control structure 40 disposed between the first magnetic component 10 and the second magnetic component 20. The first gap control structure 40 includes thixotropic material applied on the first magnetic component 10 and cured. The second magnetic component 20 is disposed on the cured first gap control structure 40, and the gap H between the first magnetic component 10 and the second magnetic component 20 is controlled by the effective height of the first gap control structure 40. Wherein, the effective height of the first gap control structure 40 as mentioned in the present disclosure refers to the maximum size of the cured first gap control structure 40 along its height direction, i.e., the maximum height of the first gap control structure 40 disposed between the first magnetic component 10 and the second magnetic component 20.

The present embodiment also provides a gap control method for the magnetic core component, which includes a first magnetic component 10 and a second magnetic component 20 arranged oppositely and a gap H is provided between the first magnetic component 10 and the second magnetic component 20. The gap control method includes following steps, applying a first gap control structure 40 on the first magnetic component 10 including thixotropic material; curing the first gap control structure 40; detecting the effective height of the first gap control structure 40 and adjusting adhesive dispensing process parameters and applying parameters so that the effective height of the first gap control structure 40 is equal to an expected value of the gap H; and assembling the second magnetic component 20 and the first magnetic component 10 to form the magnetic core component. In order to make the gap control mechanism capable of performing the above function in the components, the thixotropic material may meet the following requirements: an insulating strength greater than 10 kV/mm, a magnetic permeability of 1, a thixotropic index greater than 3, a Shore hardness more than A10 after it is cured, and a bonding strength more than 100 Pa between the thixotropic material and the magnetic core component.

In a manufacturing process, the first gap control structure 40 having a certain height is applied on a position of the first magnetic component 10 where a gap needs a control by using an adhesive dispensing process by means of equipment, and then is cured in an oven. Afterwards, the first magnetic component 10 and the second magnetic component 20 may be assembled by bonding material (not shown in FIG. 3). Preferably, the bonding material is applied between the first magnetic component 10 and the second magnetic component 20. For example, the bonding material may be positioned at outside or inside of the first magnetic component 10 and the second magnetic component 20. In addition, the bonding material may also meet following requirements: an insulating strength greater than 10 kV/mm, a magnetic permeability of 1, a Shore hardness of D after it is cured and a bonding strength more than 100 Pa between the bonding material and the magnetic core component.

The dispensing process is simple in operation, low in cost and the gap control structure has a high stability A colloid, obtained by the gap control structure under the same dispensing parameter has a consistent height. By adjusting dispensing process parameters the gap control structure may have any height within a certain range. The dispensing process parameters include, for example, an inside diameter of a plastic pin, a dispensing pressure and a dispensing speed or the like, thereby meeting design requirements of any gap within a certain range. Thus an error in height of the gap control structure may be controlled to be within ±5% after the dispensing process is completed, i.e., the error in magnetic core gap after assembly is controlled to be within ±5%. For example, the height of a gap controlled by means of the dispensing process is 50~2000 um.

Material used in the gap control structure of the present disclosure has low viscosity in the applying process, but the viscosity increases when the applying is stopped. Therefore, the gap control structure has a minimum variability after it is cured, and its effective height can always keep at a required gap height. So the gap precision may be improved, the gap control tolerance can be smaller than ±5%, and the height of the gap control structure can be controlled accurately so as to meet requirements for a magnetic core gap of any size.

Figure 4A:
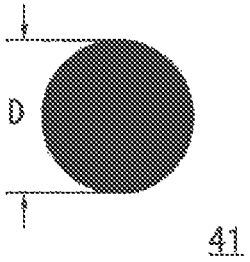
FIGS. 4A and 4B are schematic diagrams of a type of filler in a gap control structure.
Figure 4B:
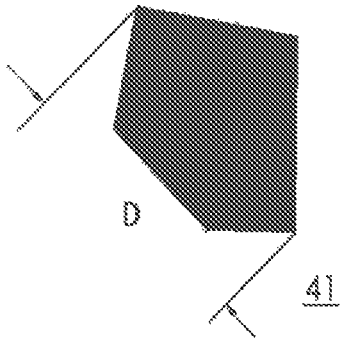

The material of the first gap control structure 40 is thixotropic material, into which some filler may be mixed so as to reach adjusting requirements for hardness and insulativity or the like of the first gap control structure 40. In the present embodiment, the first gap control structure 40 may also include a filler 41 which is doped into the thixotropic material. The filler 41 may be in any form, for example, as shown in FIGS. 4A and 4B. The particle size of the filler generally is picked out by sieving, thus being difficult for unification. The maximum particle size D of the filler 41 is smaller than a preset gap H, for example, the maximum particle size D is smaller than 80% of the preset gap H. In this case, the control gap precision mainly depends on inherent nature of the thixotropic material and is not affected by the maximum particle size tolerance of the filler, thereby facilitating an accurate control of the effective height of the first gap control structure 40. The thixotropic material may be organosilicon or epoxy resin materials, and the filler 41 may be quartz, alumina, aluminium hydroxide, zinc oxide or boron nitride and so on. The existence of the filler may be observed by means of a microscope below 1,000 times.

Figure 5:
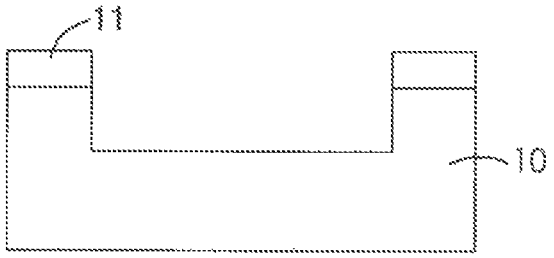
FIG. 5 is a schematic diagram of a U-shaped magnetic core component.
Figure 6:
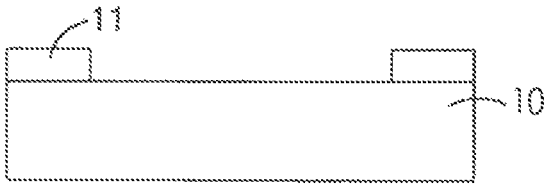
FIG. 6 is a schematic diagram of an I-shaped magnetic core component.
Figure 7:
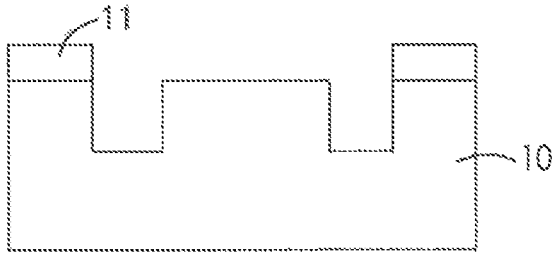
FIG. 7 is a schematic diagram of an E-shaped magnetic core component.

In the present embodiment, both the first magnetic component 10 and the second magnetic component 20 are magnetic cores, for example, a U-shaped magnetic core, an I-shaped magnetic core and an E-shaped magnetic core as shown in FIGS. 5-7 respectively. The first gap control structure 40 may be preset at a corresponding position according to different types of magnetic cores. As shown in FIG. 5, 11 indicates where the first gap control structure 40 may be disposed on two projections of the U-shaped magnetic core. As shown in FIG. 6, the first gap control structure 40 is arranged at a corresponding part where the I-shaped magnetic core and other magnetic cores are assembled and drawing reference sign 11 shows a position where the first gap control structure 40 may be arranged. As shown in FIG. 7, the first gap control structure 40 is disposed on two projections of the E-shaped magnetic core, and drawing reference sign 11 shows a position where the first gap control structure 40 may be arranged.

The gap control structure may be of any form, layout and quantity, as long as it is guaranteed there is no slant between the two upper and lower magnetic components when they are assembled.

In the present embodiment, the gap control structure generally is disposed at a position between the first magnetic component and the second magnetic component and is closest to both of them. Therefore, in addition to the U-shaped magnetic core, the I-shaped magnetic core and the E-shaped magnetic core, other magnetic cores may also be applicable.

Figure 8A:
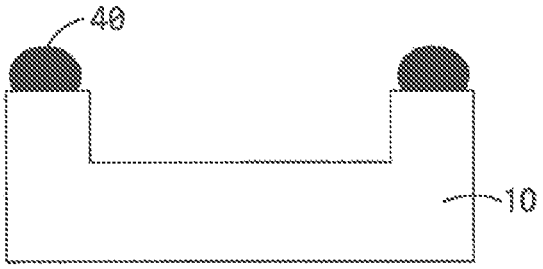
FIGS. 8A-8C are respectively a front view, a top view and a side view of a form of gap control structure.
Figure 8B:
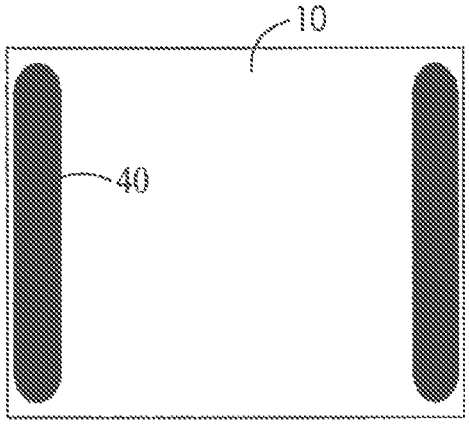
Figure 8C:
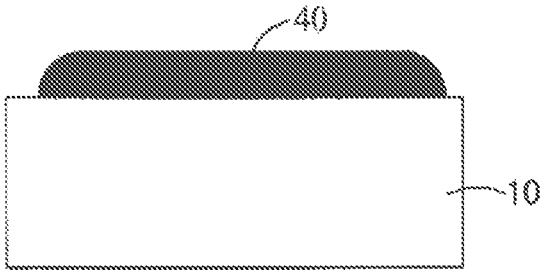

For example, the first gap control structure 40 as shown in FIGS. 8A-8C is consecutively applied at the first magnetic component 10, consistent in height and approximately shaped like an ellipse in cross section. However, the gap control structure may be in a regular shape or an irregular shape, not limited to the ellipse.

Figure 9A:
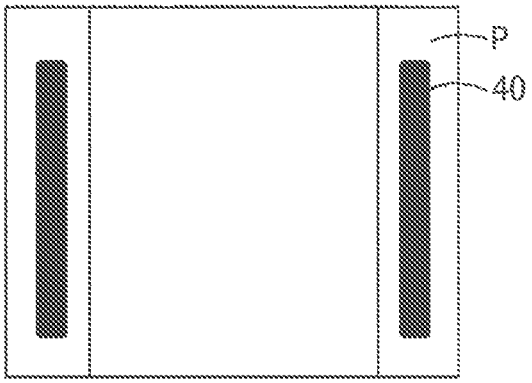
FIGS. 9A-9D are schematic diagrams of a gap control structure in different forms.
Figure 9B:
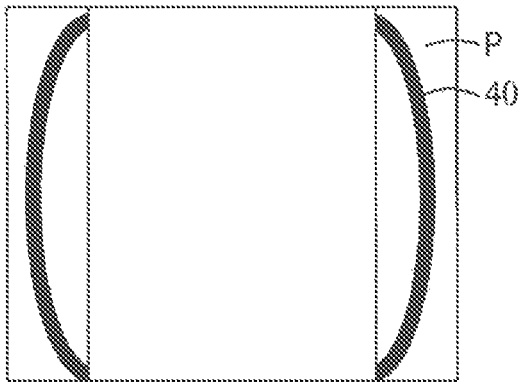
Figure 9C:
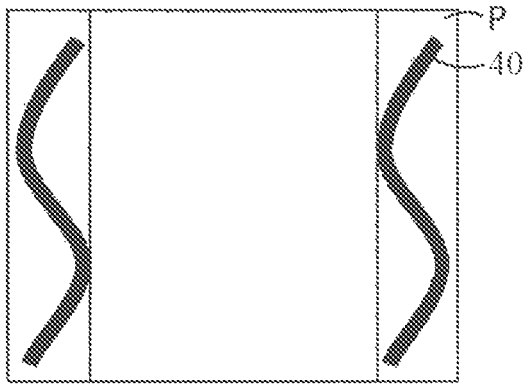
Figure 9D:
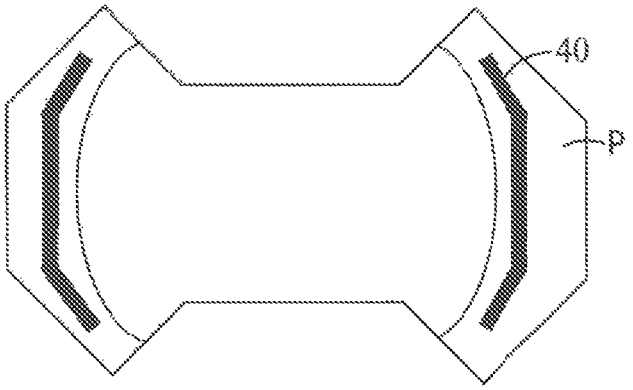

The shape of the gap control structure may be property selected according to an actual size of a gap control surface P on the magnetic component 10. If the gap control surface P is in a regular structure (for example, a rectangle), the gap control structure may be shaped like a straight line, a circular arc or a curved line and the like, as shown in FIGS. 9A-9C. If the gap control surface P is in an irregular structure, the gap control structure may be designed to comply with a required shape according to the shape of the gap control surface, as shown in FIG. 9D.

Figure 10A:
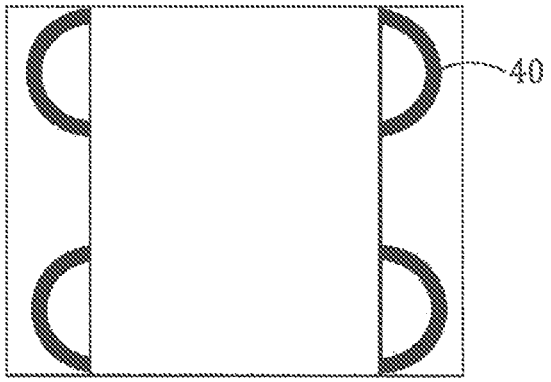
FIGS. 10A-10D are schematic diagrams of a gap control structure in different layouts.
Figure 10B:
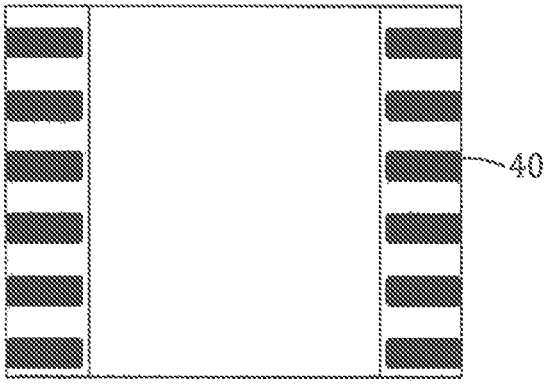
Figure 10C:
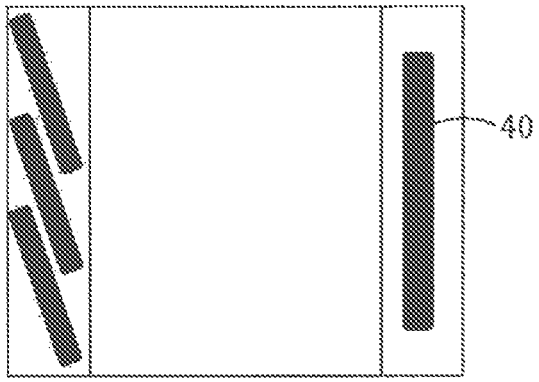
Figure 10D:
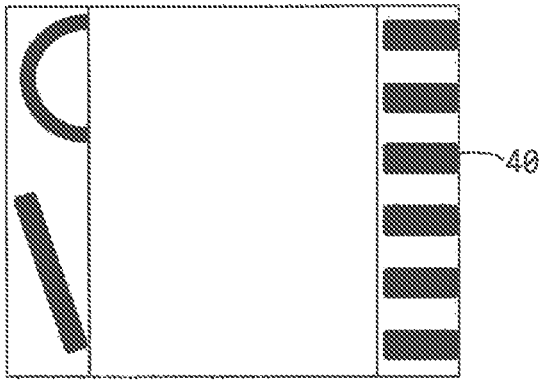

The gap control structure may have any layout as long as the two magnetic components are aligned without a slant when they are assembled, such as arranged symmetrically on both sides as shown in FIGS. 10A and 10B, or asymmetrically on both sides as shown in FIGS. 10C and 10D.

Figure 11A:
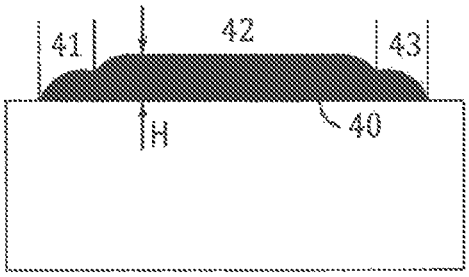
FIGS. 11A and 11B are schematic diagrams of two types of gap control structures.

Difficulty in control of heights at a starting position and an ending position by using the adhesive dispensing process may give rise to a problem that a front end part and a rear end part of the gap control structure are unstable in height. However it is easy to control the intermediate part. Thus at least a portion of the intermediate part of the gap control structure may serve as a benchmark for height control, i.e., an effective height of the gap control structure. As shown in FIG. 11A, the front end part 41 and the tear end part 43 of the first gap control structure 40 are lower than the intermediate part 42 in height by adjusting process parameters, i.e., a height of the intermediate part 42 actually is the effective height of the first gap control structure 40.

Figure 11B:
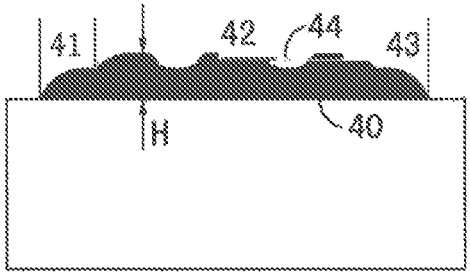

If the intermediate part 42 is long enough, a height of a portion of the intermediate part 42 may be made equal to the gap H between the first magnetic component 10 and the second magnetic component 20, and a height of another portion may be made smaller than the gap H between the first magnetic component 10 and the second magnetic component 20, so as to achieve an aim of saving materials. For example, as shown in FIG. 11B, by means of parameter control, the intermediate part 42 may be provided with a concave part 44 on some positions thereof, a height of which is lower than the effective height of the first gap control structure 40.

Referring to FIGS. 12A-12D, the difference between the magnetic core component in this embodiment and the magnetic core component in the first embodiment is in that: the magnetic core component in this embodiment further includes a third magnetic component 30 and a second gap control structure 40'. The third magnetic component 30 is disposed in a space (or a holding space) between the first magnetic component 10 and the second magnetic component 20. The third magnetic component 30 may be a coil, which is formed by a conducting layer of a PCB board, a conventional round wire, a metal foil, a flat conductor or metal conductive paste materials, or a coil which is manufactured by metal plating, deposition or other technologies. Winding loss may be affected by change of a gap between magnetic core material and the coil. Therefore, a magnetic core gap control structure and the method thereof of the present disclosure may be also applicable to control of the gap between the magnetic core material and the coil so as to reach a precise control of the gap between the magnetic core material and the coil and consequently a reduction of the winding loss.

Figure 12A:
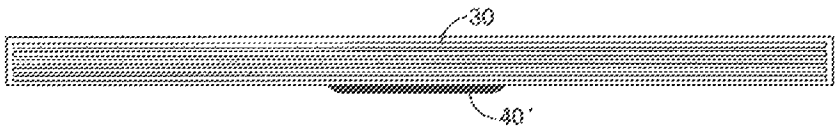
FIGS. 12A-12C are schematic diagrams of a magnetic core component according to another embodiment.
Figure 12B:
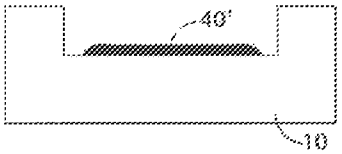
Figure 12C:
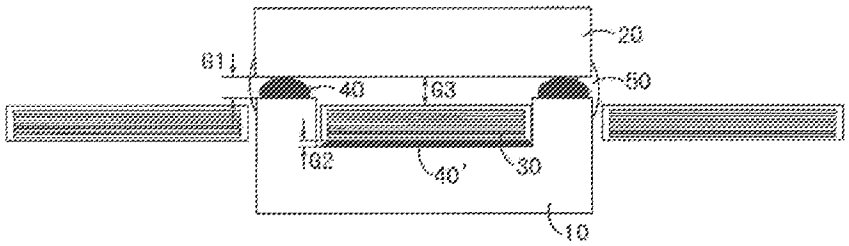
Figure 12D:
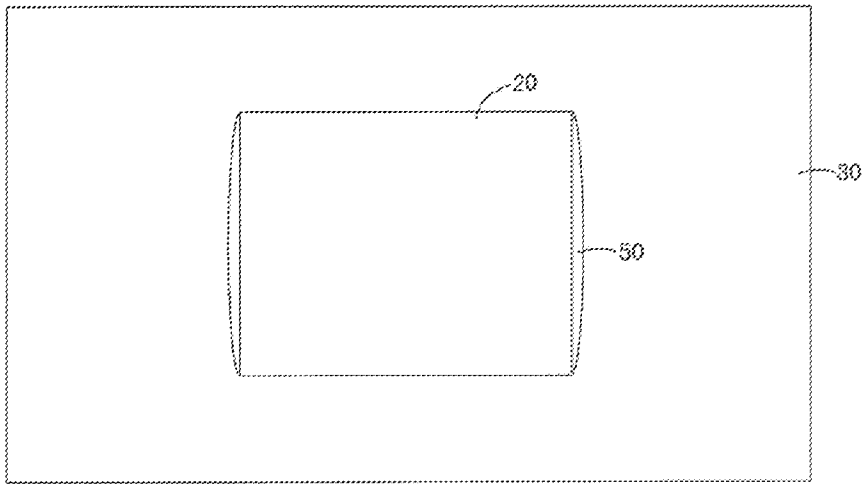
FIG. 12D is a top view of the magnetic core component illustrated as FIGS. 12A-12C.

Taking the third magnetic component 30 being a coil as an example, the gap control method is specifically as below: firstly as shown in FIG. 12A, the second gap control structure 40' having a first predetermined height is preset in the coil 30 where a gap needs a control, alternatively, as shown in FIG. 12B, the second gap control structure 40' is preset on the first magnetic component 10 where a gap needs a control. After curing, the coil 30 and the first magnetic component 10 are assembled. Afterwards, the first gap control structure 40 having a second, predetermined height is applied on the first magnetic component 10 with the method as described in the first embodiment, and the first magnetic component 10 and the second magnetic component 20 are assembled, for example by applying bonding material 50 therebetween, as shown in FIG. 12C. Because a first gap G1 between the first magnetic component and the second magnetic component and a second gap G2 between the first magnetic component 10 and the coil 30 are controlled well in precision by means of the gap control structure and the method thereof in the present disclosure, a third gap G3 between the second magnetic component 20 and the coil 30 may be controlled accordingly, and the third gap G3 is also within a small tolerance. Therefore, the first gap control structure is disposed at an assembly position between the lower surface of the coil and the first magnetic component, and the second gap control structure is disposed at an assembly position between the second magnetic component and the first magnetic component so that any two of the first gap G1, the second gap G2 and the third gap G3 may be controlled by the first gap control structure and the second gap control structure. Thus, any gap in the magnetic core component related to the magnetic core may be subject to a precise control, thereby achieving the minimum winding loss. For example, the second gap G2 may be accordingly controlled by control of the first gap G1 and the third gap G3, alternatively, the first gap G1 may be accordingly controlled by control of the second gap G2 and the third gap G3.

Figure 13:
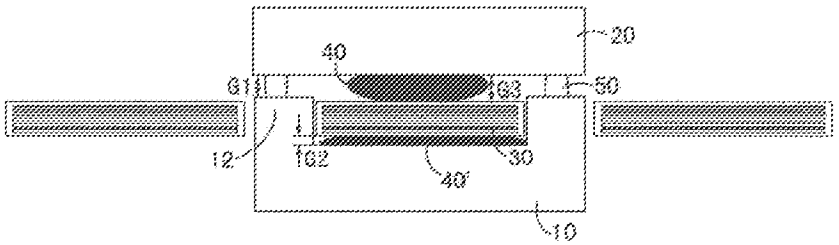
FIG. 13 is a schematic diagram of a magnetic core component according to yet another embodiment.

Referring to FIG. 13, this embodiment provides a magnetic core component, which includes a first magnetic component 10, a second magnetic component 20, a coil 30, a first gap control structure 40 and a second gap control structure 40'. The first magnetic component 10 includes two projections 12 and an accommodating space disposed between the projections 12. The coil 30 is disposed in the accommodating space of the first magnetic component 10. The second gap control structure 40' is disposed between the lower surface of the coil 30 and the first magnetic component 10, and the first gap control structure 40 is disposed between the second magnetic component 20 and the coil 30. The second magnetic component 20 and the first magnetic component 10 are arranged oppositely and assembled by applying the bonding material 50 between the first magnetic component 10 and the second magnetic component 20.

Both the first gap control structure 40 and the second gap control structure 40' include the thixotropic material, any two of the second gap G2 between the first magnetic component 10 and the coil 30, the first gap G1 between the first magnetic component 10 and the second magnetic component 20, and the third gap G3 between the second magnetic component 20 and the coil 30 are controlled by the effective height of the first gap control structure 40 and by the effective height of the second gap control structure 40'. Therefore, any gap in the magnetic core component related to the magnetic core may be subject, to a precise control, thereby achieving the minimum winding loss.

Those skilled in the art shall understand that in other embodiments, the first gap control structure 40 may also be disposed between the upper surface of the coil 30 and the second magnetic component 20, and the second gap control structure 40' may be disposed between the second magnetic component 20 and the first magnetic component 10. Material such as thermally conductive silicone is disposed between the lower surface of the coil 30 and the first magnetic component 10. Similarly, any two of the second gap between the first magnetic component 10 and the coil 30, the third gap between the second magnetic component 20 and the coil 30 and the first gap between the first magnetic component 10 and the second magnetic component 20 are controlled by the first gap control structure and second gap control structure mentioned above so as to achieve control of the remaining one gap among the three gaps.

In other words, the three gaps mentioned above may be controlled simultaneously by disposing a gap control structure between any two of the second magnetic component 20 and the first magnetic component 10, the upper surface of the coil 30 and the second magnetic component 20, and the lower surface of the coil 30 and the first magnetic component 10.

In addition, the second gap control structure is the same as the first gap control structure in material and property, and may be applied to the same applying process, arrangement and distribution manners as the first gap control structure.

Figure 14:
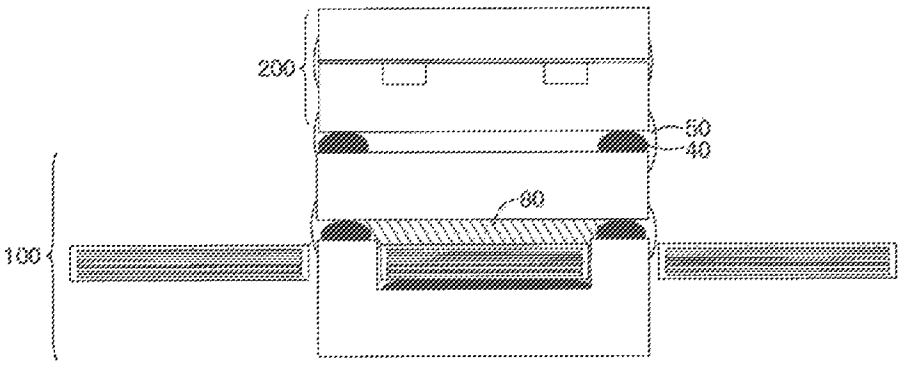
FIG. 14 is a schematic diagram of a magnetic core component according to still another embodiment.

Referring to FIG. 14, this embodiment further provides an electronic device including an electronic component and a magnetic core component which are disposed in stack. When different magnetic core materials are stacked, or other components and magnetic cores are stacked, change may arise for the gaps therebetween and may further lead to a magnetic core loss. Therefore, the magnetic core gap control structure and the method thereof in the present disclosure may also be applicable to the gap control of the stacked electronic components or magnetic core components. As shown in FIG. 14, numerical symbol 100 indicates the magnetic core component assembled by using the present disclosure, and numerical symbol 200 indicates other electronic components, for example, a resonant inductor group. A precise control of the gap between the magnetic core component 100 and the electronic component 200 relates to magnetic core loss. Therefore, the first gap control structure 40 may be disposed, in advance, on position(s) of the magnetic core component 100 or the electronic component 200 gap(s) of which needs a control by using the present disclosure, and after gap control materials are cured, the magnetic core component 100 and the electronic component 200 are assembled, thus reaching a precise control of a gap between the magnetic core component 100 and the electronic component 200. In addition, the gap of the magnetic core may be further filled with a thermally conductive adhesive or thermally conductive silicone 80 so as to improve heat dissipation capability.

In conclusion, the gap control structure of the present disclosure has a low viscosity in the adhesive dispensing and applying process, but the viscosity is increased when the applying ends. Therefore, the gap control structure has minimum variability after it is cured, and its effective height can be always kept at a required gap height. Gap precision may be improved, and gap control tolerance is smaller than ±5%. The height of the gap control structure can be accurately controlled by the present disclosure so as to meet requirements for a magnetic core gap of any size. Therefore, the gap control structure has effects of high stability, high precision, high flexibility as well as low cost, etc.

The exemplary embodiments of the present disclosure are shown and described above in detail. It shall be understood that the present disclosure is not limited to the disclosed embodiments, and instead, the present disclosure intends to encompass various modifications and equivalent arrangements within the spirit and scope of the appended claims.

What is claimed is:

1. A magnetic core component comprising:

a first magnetic component;

a second magnetic component being spaced apart from the first magnetic component; and a first gap control structure disposed between the first magnetic component and the second magnetic component at positions where the first magnetic component and the second magnetic component are closest to each other and comprising thixotropic material, wherein the first gap control structure is applied and cured on the first magnetic component, and the second magnetic component is disposed on a cured first gap control structure, so that a gap distance between the first magnetic component and the second magnetic component is controlled by disposing the cured first gap control structure to have an effectively controlled height with an expected value, and wherein the first gap control structure comprises an end part and an intermediate part, at least a portion of the intermediate part of the first gap control structure is higher than the end part in a direction of the effective height of the first gap control structure, and has a height equal to a smallest distance between the first magnetic component and the second magnetic component to serve as the effective height of the first gap control structure.

2. The magnetic core component of claim 1, wherein the first magnetic component is fixed with the second magnetic component by means of compression joint or bonding manner.

3. The magnetic core component of claim 1, wherein both the first magnetic component and the second magnetic component are magnetic cores.

4. The magnetic core component of claim 1, wherein the intermediate part is higher than the end part.

5. The magnetic core component of claim 1, wherein a height of a portion of the intermediate part is equal to the gap between the first magnetic component and the second magnetic component, and a height of another portion is smaller than the gap between the first magnetic component and the second magnetic component.

6. The magnetic core component of claim 1, further comprising:

a coil disposed in a space formed by the first magnetic component and the second magnetic component; and a second gap control structure comprising thixotropic material, which is disposed between a lower surface of the coil and the first magnetic component, wherein the first magnetic component and the second magnetic component has a first gap, the lower surface of the coil and the first magnetic component has a second gap, an upper surface of the coil and the second magnetic component has a third gap, and the first gap control structure and the second gap control structure are used to control the first gap, the second gap and the third gap.

7. The magnetic core component of claim 1, further comprising:

a coil disposed in a space formed by the first magnetic component and the second magnetic component; and a second gap control structure comprising thixotropic material, which is disposed between the upper surface of the coil and the second magnetic component, wherein the first magnetic component and the second magnetic component has a first gap, the lower surface of the coil and the first magnetic component has a second gap, an upper surface of the coil and the second magnetic component has a third gap, and the first gap control structure and the second gap control structure are used to control the first gap, the second gap and the third gap.

8. The magnetic core component of claim 1, further comprising:

a coil, which is disposed in a space formed by the first magnetic component and the second magnetic component and is a conducting layer of a PCB board, a round wire, a metal foil, a flat conductor or metal conductive paste.

9. The magnetic core component of claim 1, wherein the first gap control structure is applied on the first magnetic component by using an adhesive dispensing process.

10. A magnetic core component comprising:

a first magnetic component comprising two projections and an accommodating space disposed between the projections;

a second magnetic component arranged oppositely to the first magnetic component and being spaced apart from the first magnetic component;

a first gap control structure disposed between the projections of the first magnetic component and the second magnetic component at positions where the first magnetic component and the second magnetic component are closest to each other;

a coil disposed in the accommodating space of the first magnetic component; and a second gap control structure disposed between the first magnetic component and the coil, wherein both the first gap control structure and the second gap control structure comprise thixotropic material, the first magnetic component and the second magnetic component has a first gap, a lower surface of the coil and the first magnetic component has a second gap, an upper surface of the coil and the second magnetic component has a third gap, and the first gap control structure and the second gap control structure are used to control the first gap, the second gap and the third gap by adjusting respective effective heights of both gap control structures, the first gap control structure comprises an end part and an intermediate part, at least a portion of the intermediate part of the first gap control structure is higher than the end part in a direction of an effective height of the first gap control structure, and has a height equal to a smallest distance between the first magnetic component and the second magnetic component to serve as the effective height of the first gap control structure.

11. The magnetic core component of claim 10, wherein at least one of the first gap control structure and the second gap control structure comprises a filler doped in the thixotropic material, and a maximum particle size of the filler is smaller than 80% of the gap.

12. The magnetic core component of claim 11, wherein the filler is quartz, alumina, aluminium hydroxide, zinc oxide or boron nitride.

13. The magnetic core component of claim 10, wherein the thixotropic material is organosilicon or epoxy resin materials.

* * * * *